US009933211B2

(12) United States Patent
Hiwatashi et al.

(10) Patent No.: US 9,933,211 B2
(45) Date of Patent: Apr. 3, 2018

(54) PLATE HEAT EXCHANGER

(71) Applicants: HISAKA WORKS, LTD., Osaka (JP); Hitachi-GE Nuclear Energy, Ltd., Hitachi-shi (JP)

(72) Inventors: Isamu Hiwatashi, Higashi-Osaka (JP); Mana Iwaki, Higashi-Osaka (JP); Seiichi Matsumura, Hitachi (JP); Kiyoshi Ishihama, Hitachi (JP)

(73) Assignees: HISAKA WORKS, LTD., Osaka, Osaka (JP); Hitachi-GE Nuclear Energy, Ltd., Hitachi-shi, Ibaraki (JP)

( * ) Notice: Subject to any disclaimer, the term of this patent is extended or adjusted under 35 U.S.C. 154(b) by 257 days.

(21) Appl. No.: 14/769,064

(22) PCT Filed: Feb. 25, 2014

(86) PCT No.: PCT/JP2014/054505
§ 371 (c)(1),
(2) Date: Aug. 19, 2015

(87) PCT Pub. No.: WO2014/132959
PCT Pub. Date: Sep. 4, 2014

(65) Prior Publication Data

US 2016/0010925 A1 Jan. 14, 2016

(30) Foreign Application Priority Data

Feb. 27, 2013 (JP) ..... 2013-036919

(51) Int. Cl.
*F28D 9/00* (2006.01)
*F28F 3/08* (2006.01)
*F28F 3/10* (2006.01)

(52) U.S. Cl.
CPC ..... *F28D 9/0093* (2013.01); *F28D 9/005* (2013.01); *F28F 3/083* (2013.01); *F28F 3/10* (2013.01)

(58) Field of Classification Search
CPC ..... F28D 9/005; F28F 3/08; F28F 3/10
(Continued)

(56) References Cited

U.S. PATENT DOCUMENTS 2,550,339 A * 4/1951 Ehrman ..... F28F 3/046 165/167
2,865,613 A 12/1958 Gustaf et al.
(Continued)

FOREIGN PATENT DOCUMENTS

CN 1355879 A 6/2002
CN 1672007 A 9/2005
(Continued)

OTHER PUBLICATIONS

Office Action dated Oct. 8, 2016 in corresponding CN Application No. 201480009181.2.

*Primary Examiner* — Allen Flanigan
(74) *Attorney, Agent, or Firm* — Knobbe, Martens, Olson & Bear, LLP

(57) ABSTRACT

Provided is a plate heat exchanger that includes a plurality of heat transfer plates stacked to each other, a gasket interposed between each adjacent heat transfer plates, and a regulating member formed to be able to support at least partially the gasket. Each heat transfer plate has a fitting recessed portion formed in recessed manner on the side on which the gasket fitting groove is formed. The fitting recessed portion crosses the recessed strip while extending along the gasket fitting groove. The support part is arranged along the gasket fitting groove when the regulating member is held in fitting engagement with the fitting recessed portion. The support part is arranged along the gasket fitting
(Continued)

groove when the regulating member is held in fitting engagement with the fitting recessed portion.

4 Claims, 16 Drawing Sheets

(58) Field of Classification Search
USPC ..... 165/167
See application file for complete search history.

(56) References Cited

U.S. PATENT DOCUMENTS

| | | | | | |
|---|---|---|---|---|---|
| 2,939,686 | A * | 6/1960 | Wildermuth | F28F 3/083 165/167 |
| 4,377,204 | A | 3/1983 | Johansson | |
| 4,905,758 | A | 3/1990 | Mathur et al. | |
| 5,988,268 | A * | 11/1999 | Usami | F28F 3/10 165/166 |
| 6,935,415 | B1 | 8/2005 | Petersen et al. | |
| 2005/0269058 | A1 | 12/2005 | Tagesson | |
| 2009/0159251 | A1 * | 6/2009 | Blomgren | F28D 9/005 165/167 |
| 2010/0276125 | A1 | 11/2010 | Krantz et al. | |
| 2011/0240273 | A1 | 10/2011 | Blomgren et al. | |
| 2011/0247790 | A1 | 10/2011 | Holm et al. | |
| 2011/0259561 | A1 | 10/2011 | Krantz | |

FOREIGN PATENT DOCUMENTS

| | | | | |
|---|---|---|---|---|
| CN | 2890822 | Y | 4/2007 | |
| CN | 101918784 | A | 12/2010 | |
| CN | 102239378 | A | 11/2011 | |
| CN | 102239379 | A | 11/2011 | |
| CN | 102317733 | A | 1/2012 | |
| GB | 655076 | A * | 7/1951 | B01D 25/215 |
| JP | 5-346296 | A | 12/1993 | |
| JP | 8-271179 | A | 10/1996 | |
| JP | 10-267583 | A | 10/1998 | |
| JP | 2010-127599 | A | 6/2010 | |
| JP | 2011-117624 | A | 6/2011 | |
| JP | 2012-122688 | A | 6/2012 | |
| JP | 5253116 | B | 4/2013 | |
| WO | 00/62002 | A1 | 10/2000 | |

* cited by examiner

PLATE HEAT EXCHANGER

CROSS-REFERENCE TO RELATED APPLICATION

This application is the U.S. National Phase under 35. U.S.C. § 371 of International Application PCT/JP2014/054505, filed Feb. 25, 2014, which claims priority to Japanese Patent Application No. 2013-036919, filed Feb. 27, 2013, the disclosure of which is incorporated herein by reference in their entirety.

FIELD OF THE INVENTION

The present invention relates to a plate heat exchanger that includes a plurality of heat transfer plates stacked to each other, and a gasket interposed between each adjacent heat transfer plates which defines a flow channel for circulation of a fluid medium.

BACKGROUND ART

Hitherto, a plate heat exchanger is proposed as one of a heat exchanger for heat exchange between a first fluid medium and a second fluid medium.

A plate heat exchanger includes a plurality of heat transfer plates. The heat transfer plates each are formed by press molding a metal plate and have a plurality of recessed strips and projected strips formed on each of both front and back sides and at least four openings extending through both the front and back sides.

In the plate heat exchanger, the heat transfer plates having the above configuration are stacked to each other so as to form alternately a first flow channel for circulation of a first fluid medium and a second flow channel for circulation of a second fluid medium with each heat transfer plate therebetween.

In the plate heat exchanger, two of four openings of each heat transfer plate each are aligned with each of the corresponding two openings of each adjacent heat transfer plate to form a pair of first connection flow channels for allowing a first fluid medium to flow into and out of the first flow channel, and the remaining two openings of each heat transfer plate each are aligned with each of the corresponding two openings of each adjacent heat transfer plate to form a pair of second connection flow channels for allowing the second fluid medium to flow into and out of the second flow channel.

With the above configuration, the plate heat exchanger is configured such that the first fluid medium which has flown into the first flow channel from one of the first connection flow channels is discharged into the other of the first connection flow channels, while at the same time the second fluid medium which has flown into the second flow channel from the one of the second connection flow channels is discharged into the other of the second connection flow channels. Thus, the plate heat exchanger performs heat exchange between the first fluid medium which circulates through the first flow channel and the second fluid medium which circulates through the second flow channel via the heat transfer plates.

Meanwhile, as the plate heat exchanger of this type, there is a plate heat exchanger of a gasket type that includes gaskets each interposed between each adjacent heat transfer plates to define flow channels for circulation of fluid mediums (a first flow channel and a second flow channel).

A plurality of the heat transfer plates of the plate heat exchanger of a gasket type each form a gasket fitting groove for fittingly receiving a gasket. A more specific description is given herein. Each heat transfer plate has one side facing the adjacent heat transfer plate, and the other side opposite to the one side. Each heat transfer plate has an annular gasket fitting groove on any one of the one side and the other side, which surrounds all of the two openings, and annular gasket fitting grooves on at least one of the one side and the other side, which respectively surround the two openings other than the aforesaid two openings (the remaining two openings).

With the above configuration, in the plate heat exchanger of a gasket type, gaskets are mounted (fitted) in the respective gasket fitting grooves, and the plurality of the heat transfer plates are stacked to each other. Whereby, the respective gaskets seal the interface between each adjacent heat transfer plates, and define flow channels for circulation of fluid mediums (a first flow channel and a second flow channel) and connection flow channels for allowing the fluid mediums to flow into and out of the flow channels (a first connection flow channel and a second connection flow channel) between each adjacent heat transfer plates (see Patent Literature 1, for example).

Meanwhile, in the plate heat exchanger of a gasket type, a recessed strip formed on each heat transfer plate is formed to intersect with a gasket fitting groove in some cases.

In this case, the recessed strip is continuous with the gasket fitting groove to thereby partially open the gasket fitting groove. A more specific description is given herein. The gasket fitting groove is defined by a pair of vertical walls that are arranged with a distance from each other in a direction orthogonal to the groove longitudinal direction while facing each other. Accordingly, when the recessed strip is formed to intersect with the gasket fitting groove (when the recessed strip is formed to be continuous with the gasket fitting groove), the recessed strip causes the gasket fitting groove to open through its vertical wall.

Therefore, the gaskets defining the flow channels (the first flow channel and the second flow channel) are partially deformed toward (partially pressed into) the corresponding recessed strips due to the thermal expansion effected by the influences of heat in some cases. When the gaskets are partially deformed in this manner, a relative positional relationship between the gaskets and the heat transfer plates cannot be kept constant, which prevents the sealing performance of the flow channels (the first flow channel and the second flow channel) (the sealing performance between each adjacent heat transfer plates) from being maintained and hence may cause a fluid leakage.

CITATION LIST

Patent Literature

PATENT LITERATURE 1 JP-2012-122688 A

SUMMARY OF THE INVENTION

Problems to be Solved by the Invention

In view of the above circumstances, an object of the present invention is to provide a plate heat exchanger that is capable of preventing positional displacement of a gasket defining a flow channel, and hence maintaining an appropriate sealing performance of a flow channel for circulation of a fluid medium.

Means to Solve the Problem

According to the present invention, there is provided a plate heat exchanger including: a plurality of heat transfer plates stacked to each other; and a gasket interposed between each adjacent heat transfer plates. Each of the plurality of heat transfer plates has a front side and a back side, at least one of which has a recessed strip. At least one of the front side and the back side of each of the plurality of heat transfer plates has a gasket fitting groove for fittingly receiving the gasket, the gasket fitting groove intersecting with the recessed strip. A first flow channel for circulation of a first fluid medium and a second flow channel for circulation of a second fluid medium are alternately formed with each of the plurality of heat transfer plates therebetween, and at least one of the first flow channel and the second flow channel is defined by the gasket interposed between each adjacent heat transfer plates. The plate heat exchanger further includes a regulating member having a support part that can at least partially support the gasket. Each of the plurality of heat transfer plates has a fitting recessed portion for fittingly receiving the regulating member, the fitting recessed portion being formed in recessed manner on the side on which the gasket fitting groove is formed, the fitting recessed portion crossing the recessed strip while extending along the gasket fitting groove. The support part is arranged along the gasket fitting groove when the regulating member is held in fitting engagement with the fitting recessed portion.

According to one aspect of the present invention, it may be configured such that the regulating member has a top which is located on the adjacent heat transfer plate side, and the top of the regulating member is formed to be positioned at a height equal to or lower than a top of a projected strip located on the same side as the side of the heat transfer plate on which the fitting recessed portion is formed.

According to still another aspect of the present invention, it may be configured such that each of the plurality of heat transfer plates is formed by press molding a metal plate. Each of the plurality of heat transfer plates has: an annular gasket fitting groove formed along an outer periphery of each of the flow channels on one of the front side and the back side; a flat portion formed on the back side of the heat transfer plate along an outer periphery of the flow channel defined by the gasket fitted in the gasket fitting groove formed on the one of the front and back sides of another heat transfer plate adjacent to the other of the front and back sides of the heat transfer plate, the flat portion forming the recessed strip on the one of the front and back sides of the heat transfer plate. The gasket fitting groove formed on the one of the front and back sides intersects with the flat portion formed on the other of the front and back sides.

According to yet another aspect of the present invention, it may be configured such that each of the plurality of heat transfer plates has a positioning projection within the fitting recessed portion, and the regulating member has a cover part for covering the positioning projection.

DETAILED DESCRIPTION OF THE PREFERRED EMBODIMENT

A description is made for a plate heat exchanger according to one embodiment of the present invention with reference to the attached drawings.

Figure 1:
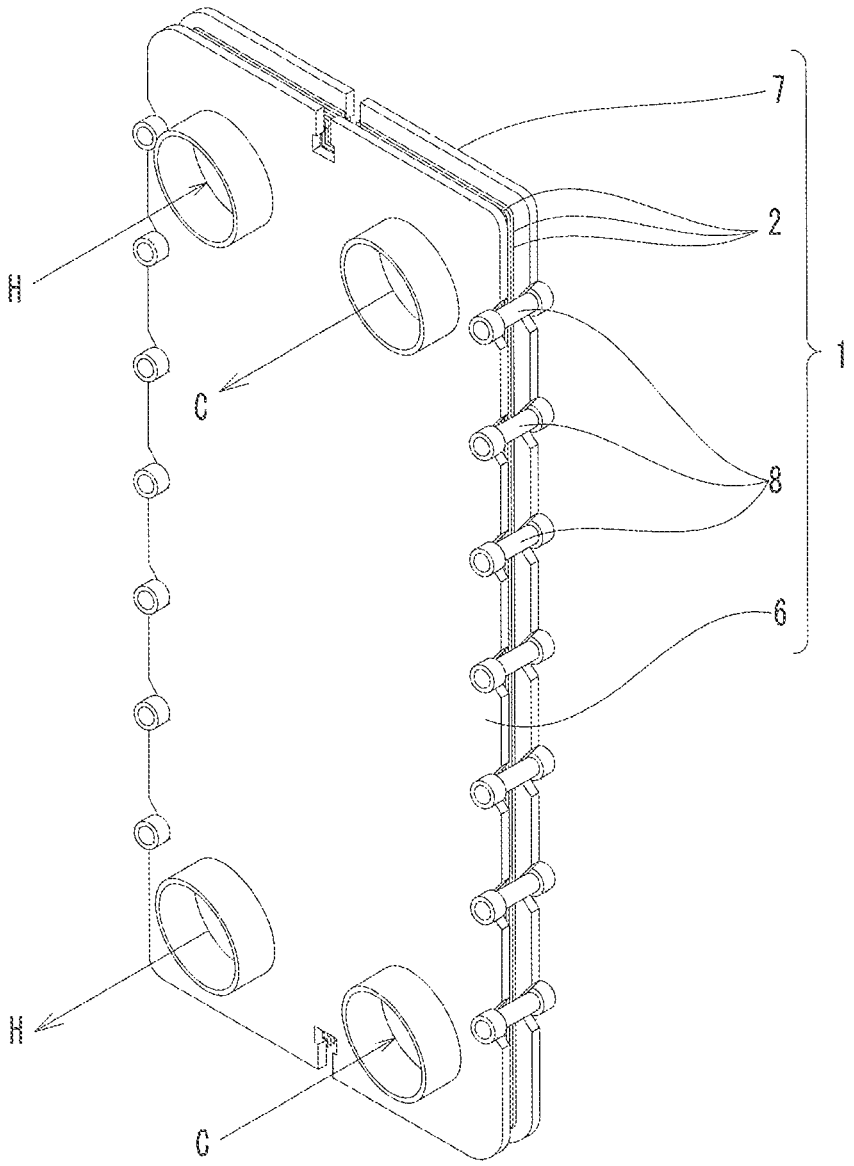
FIG. 1 is an overall perspective view of a plate heat exchanger according to one embodiment of the present invention.
Figure 2:
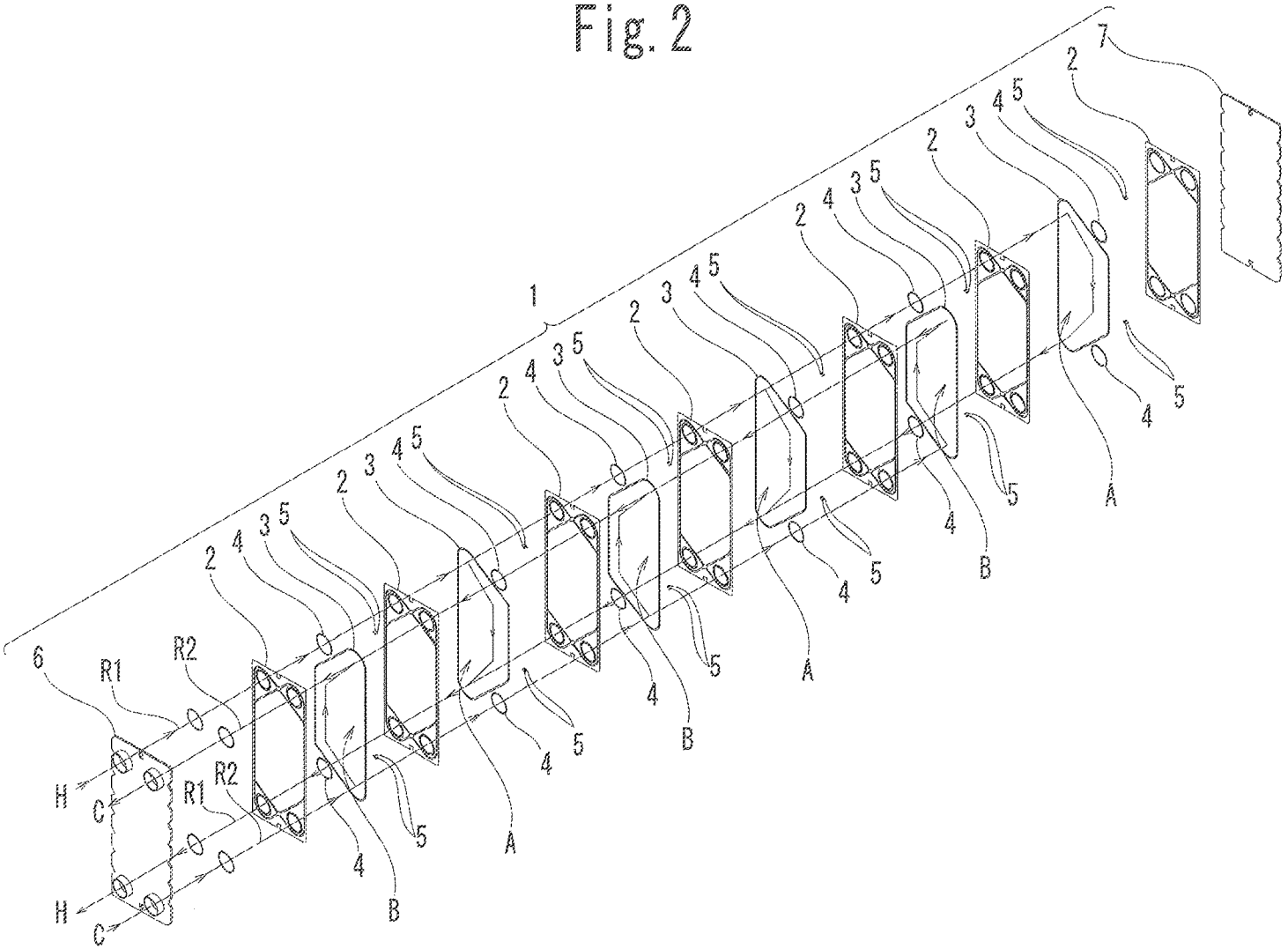
FIG. 2 is an exploded perspective view of the plate heat exchanger according to the embodiment of the present invention, which omits tie rods.

As shown in FIG. 1, a plate heat exchanger includes a plurality of heat transfer plates 2 stacked to each other. As shown in FIG. 2, a plate heat exchanger 1 according to the present embodiment includes gaskets 3 and 4 interposed between each adjacent heat transfer plates 2, and regulating members 5 formed to be able to at least partially support the gaskets 3 and 4, as well as the plurality of the heat transfer plates 2. Further, as shown in FIG. 1, the plate heat exchanger 1 of the present embodiment includes a pair of frame plates 6 and 7 that sandwich the plurality of the stacked heat transfer plates 2, in which one of the frame plates 6 and 7 has an inflow port and an outflow port, and tie rods 8 for fastening the pair of frame plates 2.

In the present embodiment, the plurality of the heat transfer plates 2 have the same configuration and therefore a description is made only for one heat transfer plate 2.

Figure 3:
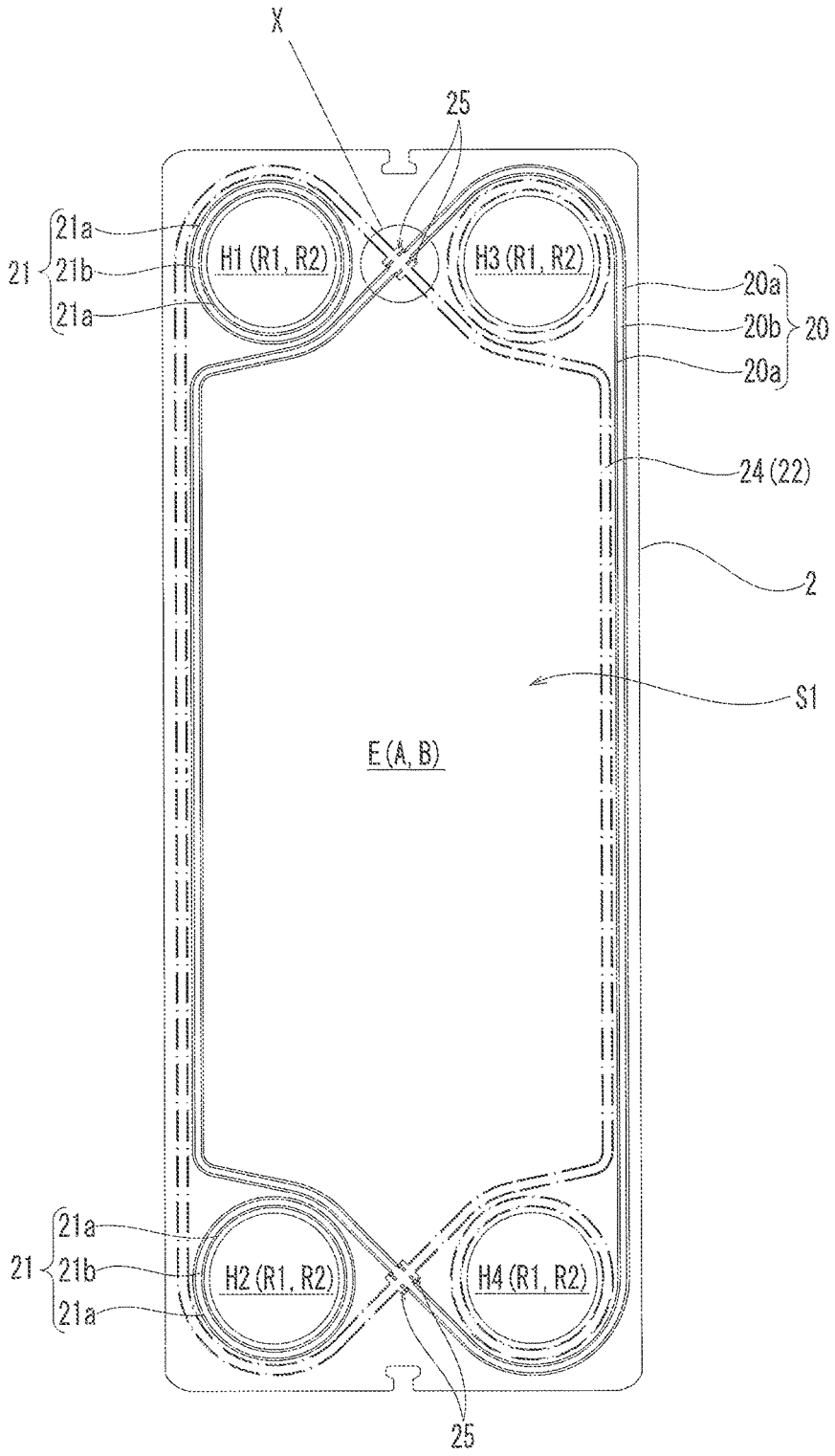
FIG. 3 is a plan view of a first side of a heat transfer plate of the plate heat exchanger of the embodiment of the present invention, in which a recessed strip (annular groove) formed on the back side of a flat portion is represented in alternate long and short dash line.
Figure 4:
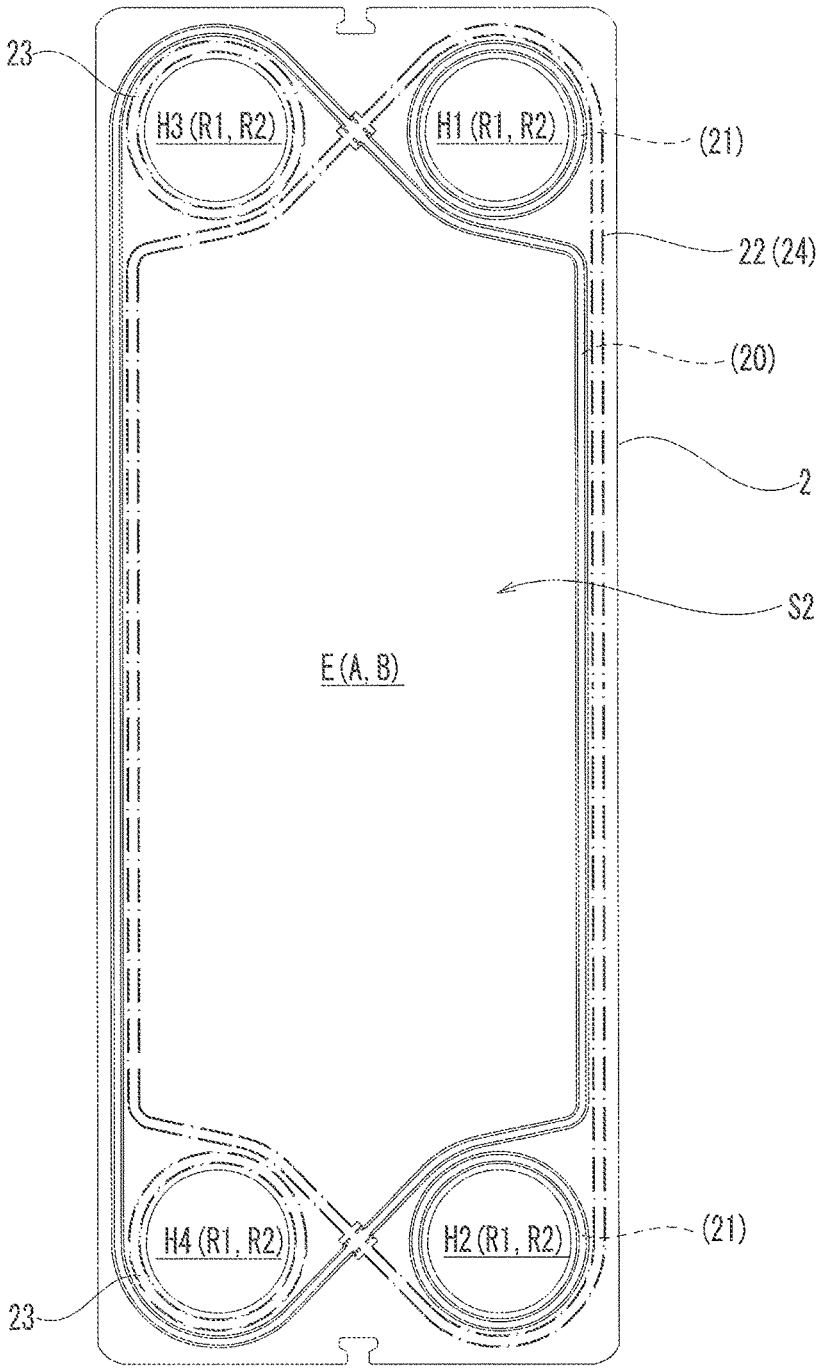
FIG. 4 is a plan view of a second side of the heat transfer plate of the plate heat exchanger of the embodiment of the present invention, in which a flat portion is represented in alternate long and short dash line.

The heat transfer plate 2 is formed by press molding a metal plate. As shown in FIG. 3 and FIG. 4, the heat transfer plate 2 has a first side (one side) S1 and a second side (another side) S2 opposite to the first side. As shown in FIG. 3, the heat transfer plate 2 has on its first side S1 annular gasket fitting grooves 20 and 21 formed along outer peripheries of flow channels A, B, R1 and R2 for circulation of fluid mediums.

As shown in FIG. 4, the heat transfer plate 2 has flat portions 22 and 23 formed on the second side S2 along the outer peripheries of the flow channels A, B, R1 and R2 defined by the gaskets 3 and 4 fitted in the gasket fitting grooves 20 and 21 formed on the first side S1 of another heat transfer plate 2 adjacent to the aforesaid second side S2. In FIG. 3, the back sides (a later-described annular groove 24 as one form of a recessed strip) of the flat portions 22 and 23 is illustrated in alternate long and short dash line, and in FIG. 4, the flat portions 22 and 23 are illustrated in alternate long and short dash line.

A more specific description is given herein. As shown in FIG. 3 and FIG. 4, the heat transfer plate 2 has a quadrangle shape in plan view. The heat transfer plate 2 has at least four openings H1, H2, H3 and H4 extending through both the front and back sides (extending through the first side and the second side). In the present embodiment, the heat transfer plate 2 has a rectangular shape in plan view and four openings H1, H2, H3 and H4.

The four openings H1, H2, H3 and H4 are formed at four corners of the heat transfer plate 2, respectively. That is, one opening H1 (hereinafter referred to as the first opening) of the four openings H1, H2, H3 and H4 is provided on one end side of the heat transfer plate 2 in a first direction which corresponds to the longitudinal direction of the heat transfer plate 2 and on one end side of the heat transfer plate 2 in a second direction which corresponds to a direction orthogonal to the longitudinal direction of the heat transfer plate 2. Another opening H2 (hereinafter referred to as the second opening) of the four openings H1, H2, H3 and H4 is provided on the other end side in the first direction and on the one end side in the second direction.

On the contrary to the above, one opening H3 (hereinafter referred to as the third opening) of the remaining two openings H3 and H4 is provided on the one end side in the first direction and on the other end side in the second direction. Further, one opening H4 (hereinafter referred to as the fourth opening) of the remaining two openings H3 and H4 is provided on the other end side in the first direction and on the other end side in the second direction.

As shown in FIG. 3, as the gasket fitting grooves 20 and 21, a first gasket fitting groove 20 having an annular shape is formed to surround all of the third opening H3 and the fourth opening H4 (two openings H3 and H4), and second gasket fitting grooves 21 each having an annular shape are formed to respectively surround the first opening H1 and the second opening H2 (the remaining two openings H1 and H2) on the first side S1 of the heat transfer plate 2.

The first gasket fitting groove 20 is formed by a pair of vertical walls 20*a* arranged with a distance from each other while facing each other, and a bottom wall 20*b* connecting lower ends of the pair of vertical walls 20*a*. The first gasket fitting groove 20 defines a heat transfer area E which serves as the flow channel A or B (any one of a first flow channel A and a second flow channel B, which are described later) on the first side S1 of the heat transfer plate 2, in which the heat transfer area E has a trapezoidal shape with its bottom side served by the other end side of the heat transfer plate 2 in the second direction.

In the present embodiment, the first opening H1, the second opening H2, the third opening H3, and the fourth opening H4 each have a circular shape. With this configuration, the first gasket fitting groove 20 has corner portions each having an arc shape positioned in a periphery of each of the third opening H3 and the fourth opening H4 while extending along each of the third opening H3 and the fourth opening H4.

Each of the second gasket fitting grooves 21 is formed by a pair of vertical walls 21*a* arranged with a distance from each other while facing each other, and a bottom wall 21*b* connecting lower ends of the pair of vertical walls 21*a*. The second gasket fitting grooves 21 define circular annular shapes on the one side of the heat transfer plate 2. In the present embodiment, the annular fitting grooves 21 each have an annular shape with a diameter smaller than the corresponding corner portion of the first gasket fitting groove 20.

On the contrary to the above, as shown in FIG. 4, the flat portions 22 and 23 are formed on the second side S2 of the heat transfer plate 2, with which the gaskets fitted in the gasket fitting grooves 20 and 21 of the adjacent first gasket fitting groove 20 come into tight contact. As the flat portions 22 and 23, the second side S2 of the heat transfer plate 2 forms thereon the first flat portion 22 having an annular shape that surrounds all of the first opening H1 and the second opening H2 (two openings H1 and H2), and the second flat portions 23 each having an annular shape that surround the third opening H3 and the fourth opening H4 (the remaining two openings H3 and H4) independently of each other.

The first flat portion 22 defines a heat transfer area E that serves as the flow channel A or B (the other of the first flow channel A and the second flow channel B) and has a trapezoidal shape with its bottom side served by the one end side of the heat transfer plate 2 in the second direction.

In the present embodiment, as described above, the first opening H1, the second opening H2, the third opening H3, and the fourth opening H4 each have a circular shape. With this configuration, the first flat portion 22 has corner portions extending along the outer peripheries of the first opening H1 and the second opening H2, respectively.

The second flat portions 23 each define a circular annular shape on the one side of the heat transfer plate 2. In the present embodiment, the second flat portions 23 each have an annular shape having a diameter smaller than the corresponding corner portion of the first flat portion 22.

With the above configuration, the first gasket fitting groove 20 and the first flat portion 22 are formed to be symmetrical to each other with reference to a center line (not shown) of the heat transfer plate 2 extending in the first direction. The second gasket fitting grooves 21 and the second flat portions 23 are formed to be symmetrical to each other with reference to the center line of the heat transfer plate 2 extending in the first direction. With this, the first gasket fitting groove 20 and the first flat portion 22 of the heat transfer plate 2 of the present embodiment respectively formed on the front and back sides are arranged to intersect with each other.

The heat transfer plate 2 has on each of its both sides (the first side S1 and the second side S2) recessed portions and projected portions, and recessed strips and projected strips (not shown). Each of the recessed portions and the projected portions, and the recessed strips and the projected strips are formed in an overlapping area (heat transfer area E) between an area surrounded by the first gasket fitting groove 20 and an area surrounded by the first flat portion 22.

As shown in FIG. 3, in the present embodiment, the heat transfer plate 2 has a fitting recessed portion 25 that is configured to fittingly receive the regulating member 5 and formed in a recessed manner along the gasket fitting groove 20 on the side (the first side S1 in the present embodiment), on which at least the gasket fitting groove 20 is formed. The fitting recessed portion 25 is formed to cross a recessed strip 24 extending in a direction intersecting with the gasket fitting groove 20.

A more specific description is given herein. As described above, the heat transfer plate 2 has the first flat portion 22 formed on the second side S2 to be symmetrically arranged to the first gasket fitting groove 20. That is, the first flat portion 22 having an annular shape which surrounds the first opening H1 and the second opening H2 is formed on the second side S2 of the heat transfer plate 2 (see FIG. 4).

The first flat portion 22 is offset toward the second side S2 of the heat transfer plate 2, and has a flat surface with the same level of height across the entire circumference. That is, the first flat portion 22 is formed by pressing one side of a metal plate. With this, the first side S1 of the heat transfer plate 2 is provided with the recessed strip 24 on the back side of the first flat portion 22, in which the recessed strip 24 has an endless annular shape in plan view (hereinafter referred to as the annular groove) and intersects with the first gasket fitting groove 20 at two places.

Figure 5:
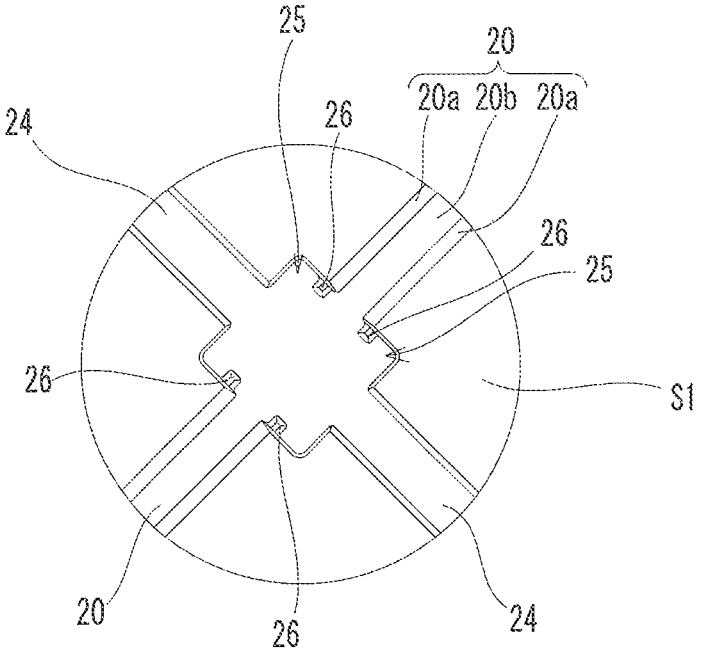
FIG. 5 is a partially enlarged view of a heat transfer plate of the plate heat exchanger of the embodiment of the present invention, and specifically an enlarged plan view of a portion represented by "X" in FIG. 3.

With the above configuration, as shown in FIG. 3 and FIG. 5, the heat transfer plate 2 has the fitting recessed portion 25 that is formed in recessed manner along the first gasket fitting groove 20 on the side (the first side S1 in the present embodiment) on which the first gasket fitting groove 20 is formed, and that is formed to cross the annular groove 24 formed on the back side of the first flat portion 22 extending in a direction intersecting with the first gasket fitting groove 20. The heat transfer plate 2 has the fitting recessed portions 25 on both sides of the first gasket fitting groove 20 at each of the two places at which the annular groove 24 intersects with the first gasket fitting groove 20.

As shown in FIG. 5, positioning projections 26 for positioning the regulating member 5 are provided in the fitting recessed portion 25 (the recessed portion). In the present embodiment, the positioning projections 26 are provided on both sides of the annular groove 24 (on both sides of a passing area of the annular groove 24). In the present embodiment, two positioning projections 26 are provided on each of both sides of the annular groove 24.

In the present embodiment, each of the positioning projections 26 is formed to be continuous with a portion adjacent to the fitting recessed portion 25. That is, each of the positioning projections 26 is formed by causing each of the pair of vertical walls defining the fitting recessed portion 25, which face each other and are arranged with a distance from each other in a direction in which the first gasket fitting groove 20 extends, to bulge toward the inside the fitting recessed portion 25.

Each of the positioning projections 26 is a portion to be covered by the regulating member 5 and therefore has a height lower than the projected strip within the heat transfer area E. That is, each of the positioning projections 26 projects by an amount equivalent to at least the thickness of the regulating member 5 (an amount equivalent to a plate thickness of a portion to be covered 51), that is, a projecting amount lower than the projected strip of the heat transfer area E so that each of the positioning projections 26 does not project further than the projected strip of the heat transfer area E.

As shown in FIG. 2, the plate heat exchanger 1 of the present embodiment includes, as the gaskets 3 and 4, a first gasket 3 having an annular shape and configured to be fitted in the first gasket fitting grooves 20, and second gaskets 4 each having an annular shape and configured to be fitted in the second gasket fitting grooves 21, respectively. A description is herein made for one first gasket 3 and one second gasket 4.

The first gasket 3 has a trapezoidal annular shape to define an area having a trapezoidal shape in plan view to conform with the planar form of the first gasket fitting groove 20. On the other hand, the second gasket 4 has a circular annular shape to define an area having a circular shape in plan view to conform with the planar form of the second gasket fitting grooves 21.

The regulating member 5 is disposed between each adjacent heat transfer plates 2. Accordingly, the plate heat exchanger 1 includes a plurality of the regulating members 5. Since the regulating members 5 have the same configuration, a description is made only for one regulating member 5.

Figure 6A:
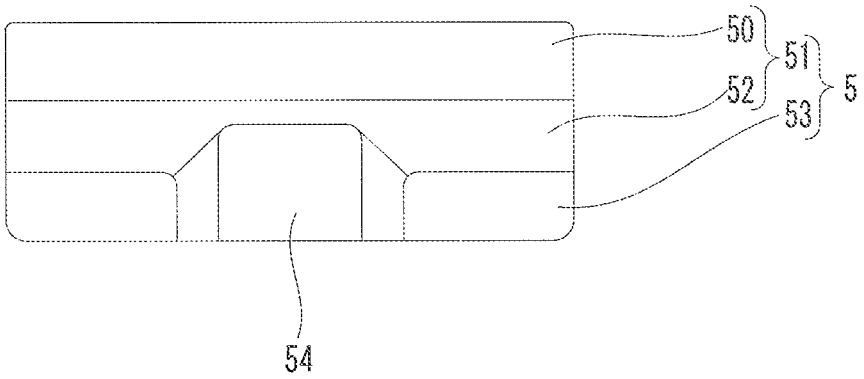
FIG. 6A is a plan view of a regulating member of the plate heat exchanger of the embodiment of the present invention.
Figure 6B:
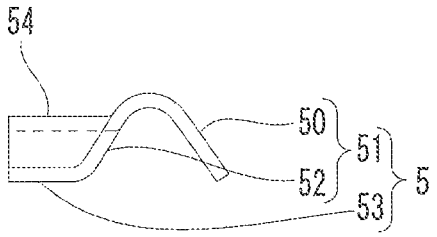
FIG. 6B is a side view of the regulating member of the plate heat exchanger of the embodiment of the present invention.

As shown in FIG. 6A and FIG. 6B, the regulating member 5 includes a support part 50 that partially supports the first gasket 3. The regulating member 5 of the present embodiment has a cover part 51 that includes the support part 50 and covers the positioning projections 26.

A more specific description is given herein. In the regulating member 5 of the present embodiment, the cover part 51 is formed by press molding a metal plate in folding-upward manner to have the support part 50, which is aligned with or substantially aligned with one of the vertical walls 20*a* forming the first gasket fitting groove 20, and an opposing part 52 which is arranged with a distance from the support part 50 while facing the support part 50.

The support part 50 and the opposing part 52 have a longitudinal axis in one direction and one ends in a direction orthogonal to the longitudinal direction which are connected with each other, and the other ends which are spaced apart from each other. The support part 50 and the opposing part 52 may be directly connected with each other, or may be indirectly connected with each other through a strip-shaped connection part which connects one end portions of the support part 50 and the opposing part 52. In the regulating member 5 of the present embodiment, the one end portions of the support part 50 and the opposing part 52 are directly connected with each other.

The regulating member 5 of the present embodiment has an extension part 53 that extends outward from the opposing part 52. The extension part 53 of the present embodiment is connected with the other end portion of the opposing part 52, and has a reinforcing part 54 at its center portion in the longitudinal direction. The reinforcing part 54 is formed with the extension part 53 partially bulging.

As shown in FIG. 7 to FIG. 10, the regulating member 5 (the cover part 51 and the extension part 53) is entirely fitted in the fitting recessed portion 25.

Figure 11:
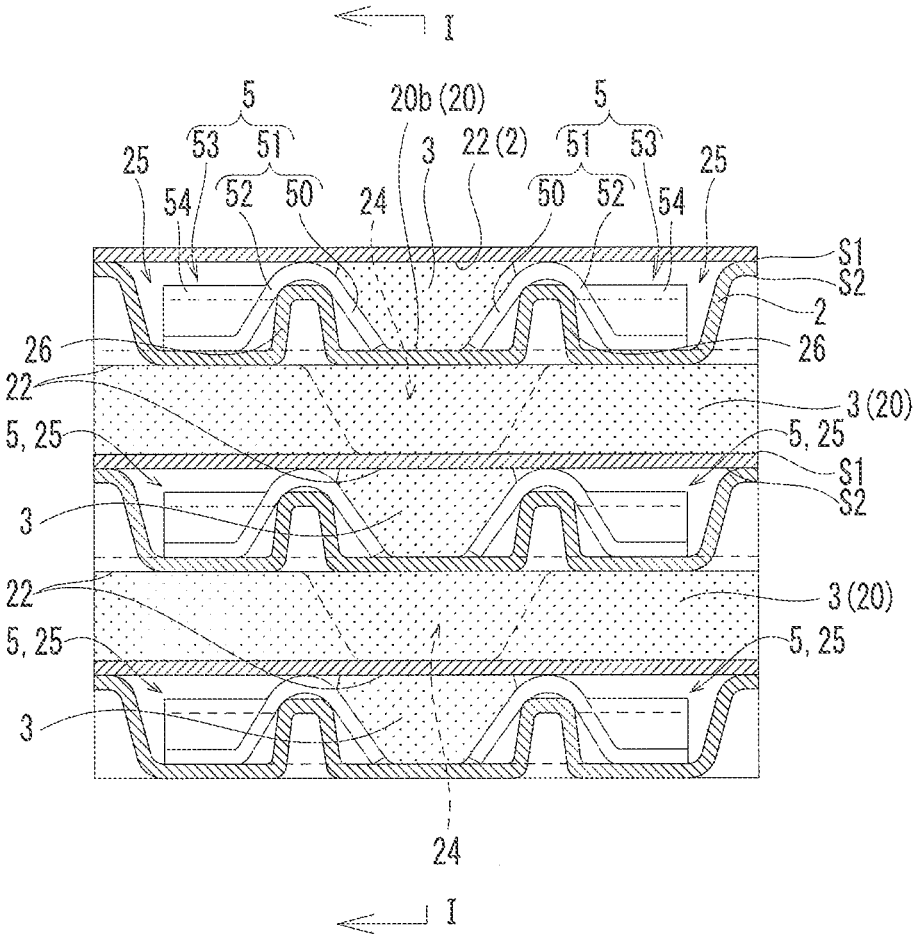
FIG. 11 is a partially enlarged cross sectional view of the plate heat exchanger of the embodiment of the present invention, and specifically a partially enlarged cross sectional view, which includes a crossing portion between the first gasket fitting groove and the recessed strip (annular groove), and its periphery.
Figure 12:
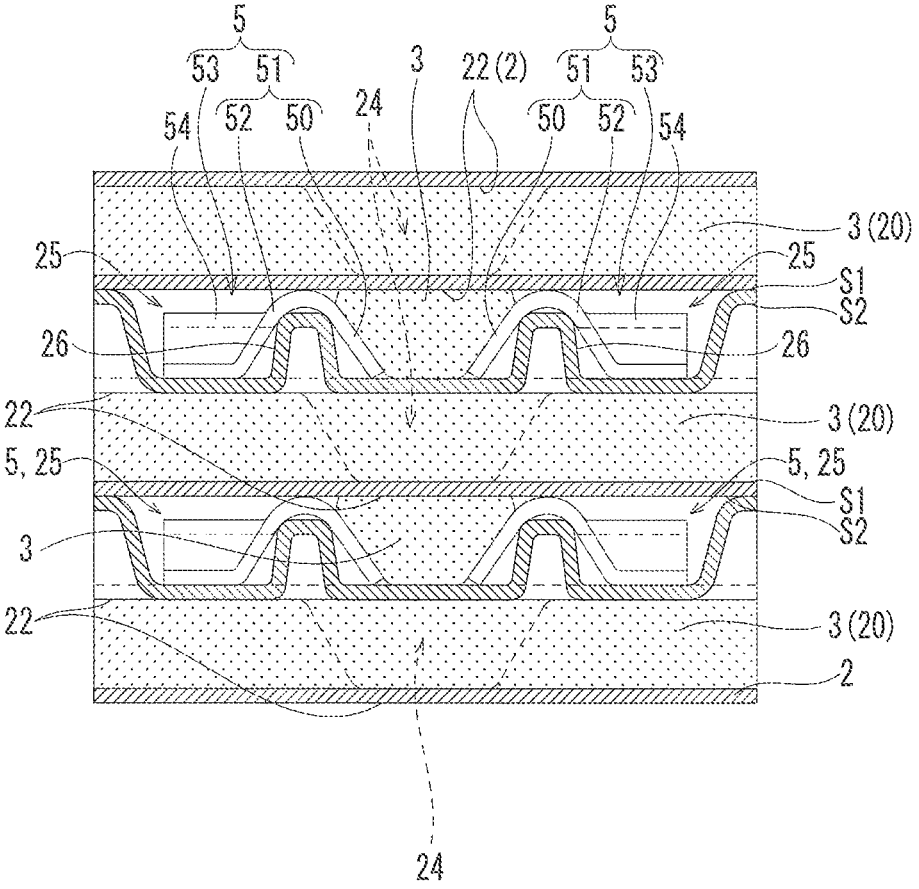
FIG. 12 is a cross sectional view taken along a line I-I in FIG. 11.

More specifically, as described above, the positioning projections 26 are formed within the fitting recessed portion 25 of the heat transfer plate 2, and therefore, as shown in FIG. 11 and FIG. 12, the regulating member 5 is fitted in the fitting recessed portion 25 with the positioning projections 26 covered by the cover part 51.

With the above configuration, the regulating member 5 is prevented from moving in a direction orthogonal to the direction in which the first gasket fitting groove 20 extends due to interference of the cover part 51 (the support part 50 and the opposing part 52) relative to the positioning projections 26. The support part 50 of the regulating member 5 is formed to have its outer surface (inclined surface) being aligned with the vertical wall (inclined surface) 20*a* of the first gasket fitting groove 20 on the same plane, when the regulating member 5 is held in fitting engagement with the fitting recessed portion 25.

The regulating member 5 of the present embodiment is configures such that, when the regulating member 5 of the present embodiment is held in a state where the cover part 51 covers the positioning projections 26, both end portions of the cover part 51 are supported on the two positioning projections 26. Whereby, the regulating member 5 is prevented from rotating about the axis extending in a direction orthogonal to the direction in which the first gasket fitting groove 20 extends (the direction corresponding to the plate thickness of the heat transfer plate 2). In the present embodiment, the height of the cover part 51 is set so as not to have a top of the cover part 51 (a connecting portion between the support part 50 and the opposing part 52) projecting further outward than the projected strip of the heat transfer area E.

The regulating member 5 having the above configuration is fixed relative to the heat transfer plate 2 when it is held in fitting engagement with the fitting recessed portion 25. The regulating member 5 may be fixed to the heat transfer plate 2 using adhesive agent or adhesive tape, or may be fixed to the heat transfer plate 2 by welding.

Figure 7:
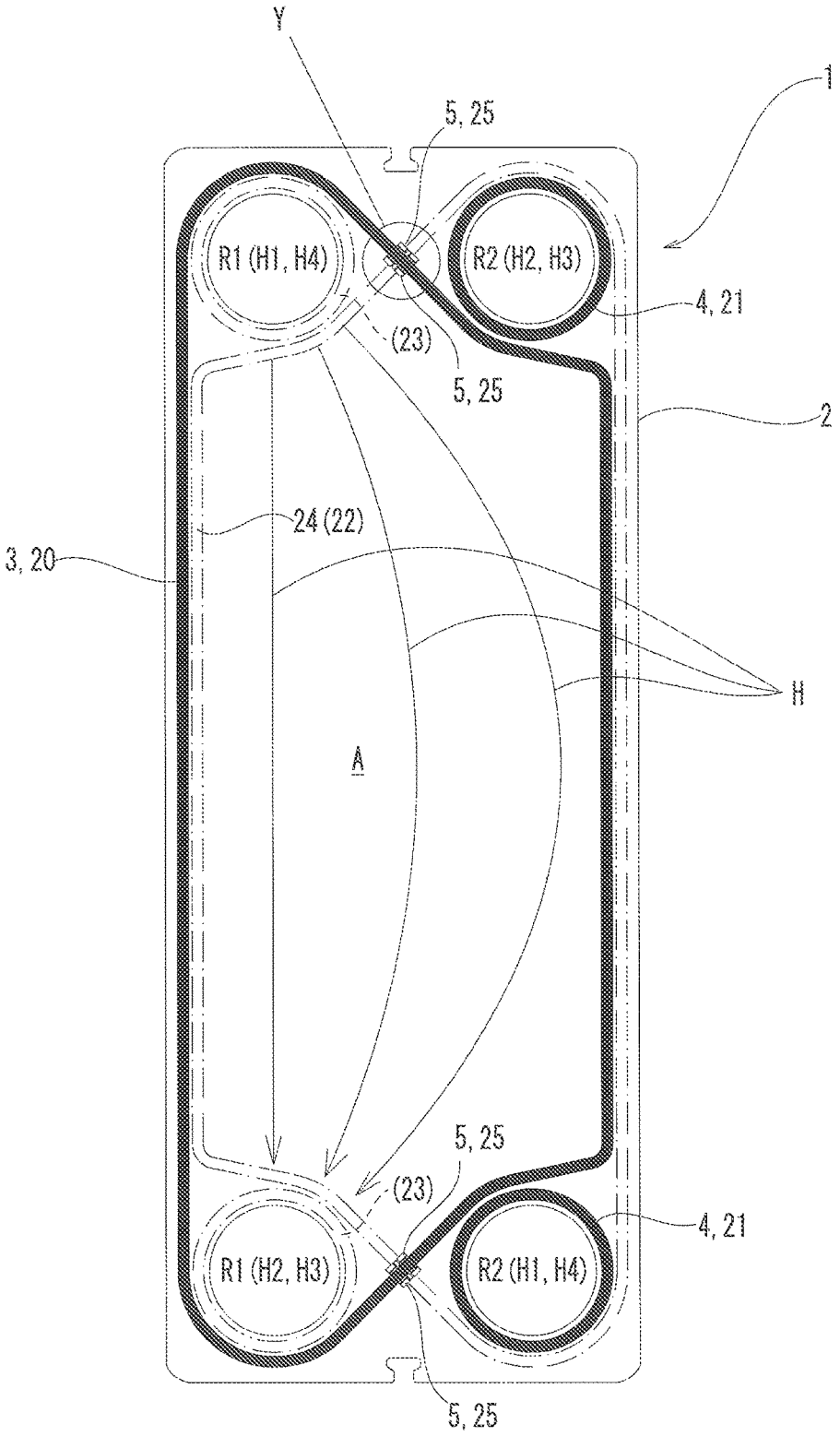
FIG. 7 is a view showing a state in which gaskets are mounted to the heat transfer plate of the plate heat exchanger of the embodiment of the present invention, in which a first flow channel is formed by a gasket (first gasket).
Figure 8:
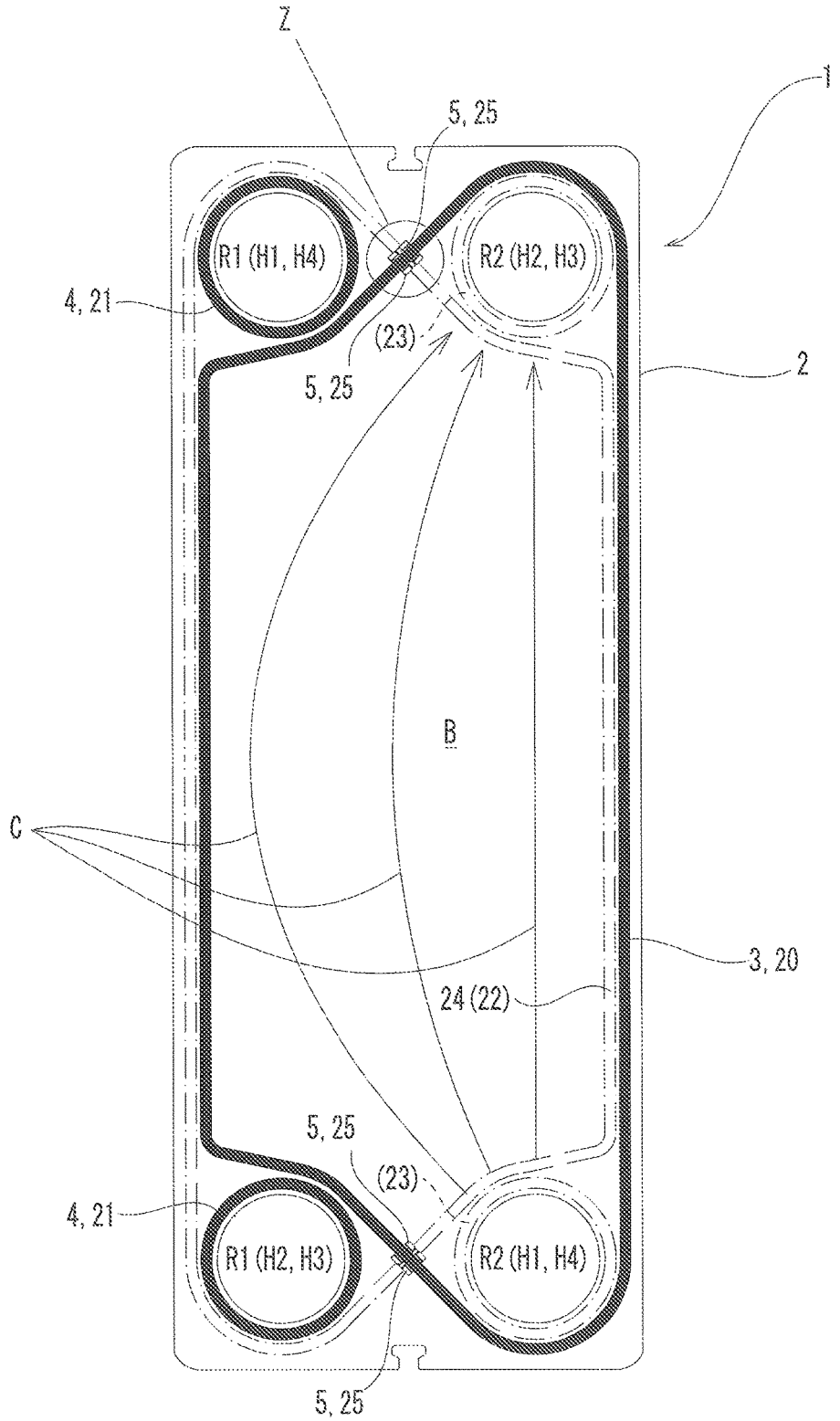
FIG. 8 is a view showing a state in which gaskets and a regulating member for fittingly receiving the gasket and regulating the movement of the gasket are mounted to the heat transfer plate of the plate heat exchanger of the embodiment of the present invention, in which a second flow channel is formed by a gasket (first gasket).
Figure 9:
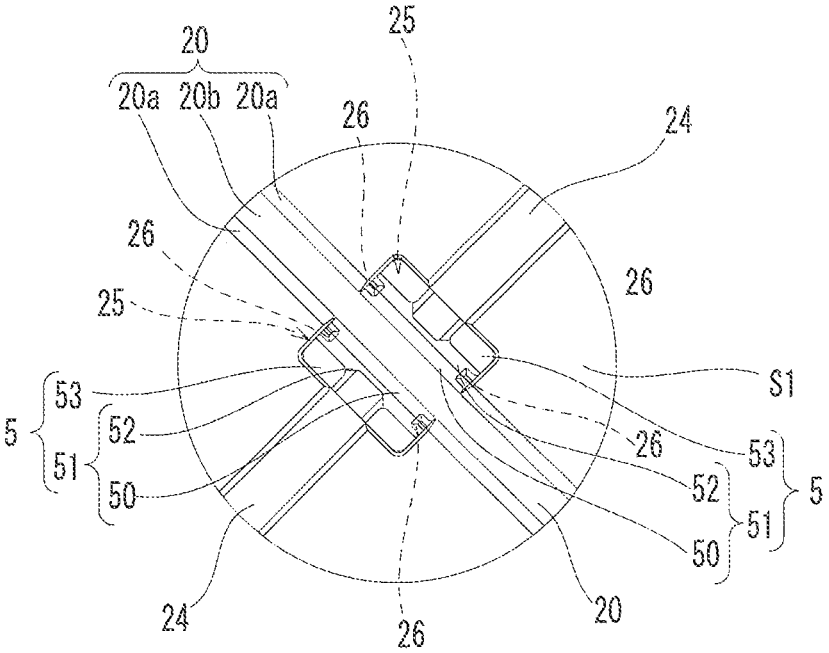
FIG. 9 is a partially enlarged plan view, and specifically an enlarged plan view of a portion represented by "Y" in FIG. 7, in which gaskets are omitted.
Figure 10:
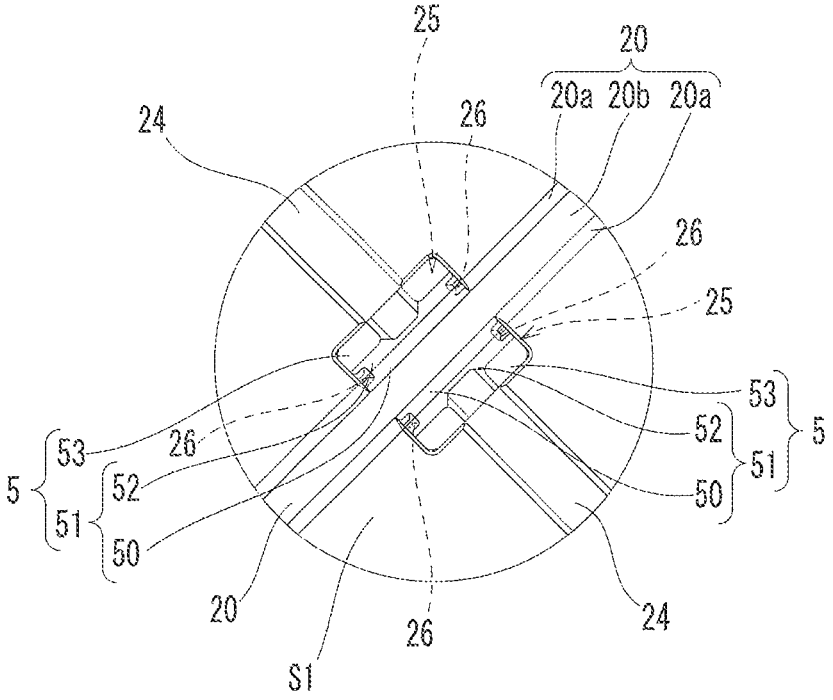
FIG. 10 is a partially enlarged plan view, and specifically an enlarged plan view of a portion represented by "Z" in FIG. 8.

The plate heat exchanger 1 of the present embodiment is configured as described above. As shown in FIG. 7 and FIG. 8, in the plate heat exchanger 1, the first gasket 3 is fitted in each of the first gasket fitting grooves 20 of the plurality of the heat transfer plate 2, and the second gaskets 4 are fitted in the second gasket fitting grooves 21. Then, the plurality of the heat transfer plates 2 are stacked to each other. More specifically, in the plate heat exchanger 1 of the present embodiment, every other heat transfer plate 2 in a third direction orthogonal to the first direction and the second direction (stacking direction) is turned around 180 degrees about the axis extending in the third direction, and then those heat transfer plates 2 are stacked to each other.

Whereby, as shown in FIG. 11 and FIG. 12, the first gasket 3 fitted in the first gasket fitting groove 20 of one of each adjacent heat transfer plates 2 lies on top of the first flat portion 22 of the other of each adjacent heat transfer plates 2. Although not illustrated, the second gaskets 4 fitted in the second gasket fitting grooves 21 of the one of each adjacent heat transfer plates lie on top of the second flat portions 23 of the other of each adjacent heat transfer plates.

The pair of frame plates 6 and 7 sandwich the plurality of the stacked heat transfer plates 2 and are tightened with the tie rods 8 (see FIG. 1). With this configuration, the first gasket 3 and the second gaskets 4 are sandwiched by each adjacent heat transfer plates 2 and thus the interface between each adjacent heat transfer plates is sealed.

Whereby, the plate heat exchanger 1 is provided with the first flow channel A for circulation of the first fluid medium and the second flow channel B for circulation of the second fluid medium B each are alternately formed with each of the plurality of the heat transfer plates 2 therebetween, as shown in FIG. 2, FIG. 7 and FIG. 8. In the plate heat exchanger 1, two of four openings of each heat transfer plate 2 each are aligned with each of the corresponding two openings of each adjacent heat transfer plate 2 to form a pair of first connection flow channels R1 for allowing a first flow H to flow into and out of the first flow channel A, and the remaining two openings of each heat transfer plate 2 each are aligned with each of the corresponding two openings of each adjacent heat transfer plate 2 to form a pair of second connection flow channels R2 for allowing a second fluid medium C to flow into and out of the second flow channel B.

In the present embodiment, as described above, every other heat transfer plate 2 of the identical heat transfer plates 2 is turned around 180 degrees so that the first opening H1 and the fourth opening H4 are alternately aligned with each other at two places to form the one first connection flow channel R1 while forming the one second connection flow channel R2, and the second opening H2 and the third opening H3 are alternately aligned with each other at two places to form the other first connection flow channel R1, while forming the other second connection flow channel R2.

With the above configuration, in the plate heat exchanger 1 of this type, the first fluid medium H flows into the first flow channel A from the one first connection flow channel R1 and the first fluid medium H passing through the first flow channel A flows out into the other first connection flow channel R1, and at the same time, the second fluid medium C flows into the second flow channel B from the one second connection flow channel R2 and the second fluid medium C passing through the second flow channel B flows out into the other second connection flow channel R2. That is, the plate heat exchanger 1 is configured to perform heat exchange between the first fluid medium H circulating through the first flow channel A and the second fluid medium C circulating through the second flow channel B via the heat transfer plates 2.

At this time, even when at least one of the fluid pressure of the first fluid medium H circulating through the first fluid medium A and the fluid pressure of the second fluid medium C circulating through the second flow channel B acts on the first gasket 3, the first gasket 3 is maintained through its entire length (entire circumference) within the first gasket fitting groove 20.

More specifically, the plate heat exchanger 1 of the present embodiment forms the annular groove 24 intersecting with the first gasket fitting groove 20, as shown in FIG. 11 and FIG. 12. In this regard, each of the plurality of the heat transfer plates 2 has the fitting recessed portion 25 that is configured to be able to fittingly receive the regulating member 5, that is formed in recessed manner along the first gasket fitting groove 20 on the side on which the first gasket fitting groove 20 is formed, and that is formed to cross the annular groove 24 extending in a direction intersecting with the first gasket fitting groove 20, in which the regulating member 5 is disposed along the first gasket fitting groove 20, while it is held in fitting engagement with the fitting recessed portion 25.

With the above configuration, the regulating member 5 is interposed in fixed state between the annular groove 24 and the first gasket fitting groove 20 extending in a direction intersecting with the annular groove 24, and therefore the annular groove 24 does not open through the first gasket fitting groove 20. That is, the regulating member 5 fitted in the fitting recessed portion 25 is held in a state where the regulating member 5 is surrounded by the vertical walls defining the fitting recessed portion 25 and therefore is prevented from moving. When the regulating member 5 is held in fitting engagement with the fitting recessed portion 25, the support part 50 extends along the first gasket fitting groove 20 and is interposed between the annular groove 24 and the first gasket fitting groove 20.

Whereby, the annular groove 24 does not open through the first gasket fitting groove 20, and the first gasket 3 fitted in the first gasket fitting groove 20 is supported by the vertical walls 20*a* defining the first gasket fitting groove 20 and the support part 50 of the regulating member 5.

Therefore, even when the fluid pressures of the fluid medium H and the fluid medium C respectively circulating through the flow channel A and the flow channel B, which are defined by the first gasket 3 interposed between each adjacent heat transfer plates 2, has acted on the first gasket 3, the first gasket 3 is supported by the vertical walls 20*a* defining the first gasket fitting groove 20 and the regulating member 5 (support part 50). With this configuration, the first gasket 3 is prevented from being partially displaced into the annular groove 24 due to the action of the fluid pressure and therefore the relative positional relationship between the first gasket 3 and the heat transfer plates 2 is kept constant. Thus, the sealing performance of the flow channels A and B (the first flow channel A and the second flow channel B) (the sealing performance between each adjacent heat transfer plates) is maintained, and hence the leakage of fluid is prevented from occurring.

In particular, the regulating member 5 is formed to have its top, which is located on the side of each corresponding adjacent heat transfer plates 2, having a height equal to or lower than the top of the projected strip (projected strip formed in the heat transfer area E) which lies on the same plane as that of the fitting recessed portion 25 of the heat transfer plate 2. Thus, the arrangement where the heat transfer plates 2 are stacked to each other, each regulating member 5 does not interfere with each adjacent heat transfer plate 2 so that each first gasket 3 can be effectively sandwiched by each adjacent heat transfer plates 2.

With the configuration where the heat transfer plates 2 each are formed by press molding a metal plate, has the first gasket fitting groove 20 having an annular shape formed along an outer periphery of each of the flow channels A and B on the first side S1, and has the first flat portion 22 that is formed along the outer periphery of each of the flow channels A and B and that is defined by the first gasket 3 fitted in the first gasket fitting groove 20 formed on the first side S1 of each heat transfer plate 2 adjacent to the second side S2, in which the first gasket fitting groove 20 on the front side intersects with the first flat portion 22 on the back side, it is possible to form the first flat portion 22 with the same level of height across the entire circumference, even when the heat transfer plates 2 each are formed by press molding a metal plate even with the first gasket fitting groove 20 on the front side intersecting with the first flat portion 22 on the back side.

That is, in the case where the heat transfer plates 2 each are formed by press molding a metal plate, the recess-projection configuration is reversed on the front side and the back side so that the projection on one side becomes a recess on the other side. Thus, in order to prevent positional displacement of the first gasket 3, it is conceivable to form a projection between the first gasket fitting groove 20 and the annular groove 24 to prevent the movement of the first gasket, but when forming such a projection by press molding, the back side thereof becomes a recess.

Therefore, as described above, when the first gasket fitting groove 20 and the first flat portion 22 are formed so as to intersect with each other on the front and back sides, the continuous formation of the first flat portion 22 is interrupted with a recess formed on the back side of the projection in the periphery of the area at which the first gasket fitting groove 20 intersects with the first flat portion 22. Because of this, the first gasket 3 fitted in the first gasket fitting groove 20 of each adjacent transfer plates 2 cannot tightly contact with the first flat portion 22 throughout the entire length without interruption. That is, each first gasket 3 cannot tightly contact each adjacent heat transfer plate 2 due to the presence of the recess formed on the back side of the projection, and hence the flow channels A and B cannot be fluid tightly formed.

Because of the above, it is necessary to take a measure such as disposing an infilling member within the recess to infill the recess, but this measure necessitates securing of the close contact between the infilling member of such a proposed measure and each of the heat transfer plates 2. Otherwise, fluid leakage may occur.

On the contrary, in the plate heat exchanger 1 of the present embodiment, the fitting recessed portion 25 is formed in recessed manner for fittingly receiving the regulating member 5 and therefore the back side is projected. Thus, the first flat portion 22 has a consecutive annular shape without interruption. Therefore, the first gasket 3 fitted in the first gasket fitting groove 20 of one of each adjacent heat transfer plates 2 tightly contacts the first flat portion 22 throughout its entire circumference of the other of each adjacent heat transfer plates 2. Whereby, it is possible to effectively prevent fluid leakage in any of the flow channels A and B (first flow channel A and second flow channel B).

In the present embodiment, the heat transfer plates 2 each have the positioning projections 26 within the fitting recessed portion 25, and the regulating member 5 has the cover part 51 for covering the positioning projections 26. Thus, the cover part 51 interferes with the positioning projections 26 of each heat transfer plate 2 and thus the regulating member 5 is secured at a certain position relative to the heat transfer plate 2 (fitting recessed portion 25).

As a result, it is possible to securely prevent the regulating member 5 from being moved due to pressing with the first gasket 3 when the pressures of the fluid mediums H and C have acted on the first gasket 3 supported by the regulating member 5. In particular, in the present embodiment, since the positioning projections 26 are formed at a position avoiding the position, on the back side of which the recessed strip (annular groove) 24 is formed, it is possible to secure the continuous formation of the first flat portion 22 (the surface which the first gasket 3 tightly contacts).

It is a matter of course that the present invention is not necessarily limited to the above embodiment, and can be appropriately modified without departing from the gist of the present invention.

In the above embodiment, for the annular groove 24 provided as one form of a recessed strip intersecting with the first gasket fitting groove 20, the fitting recessed portion 25 crossing the annular groove 24 is formed, and the regulating member 5 is fitted in the fitting recessed portion 25. However, the present invention is not necessarily limited to this. For example, in the case where the recessed strip of the heat transfer area E (recessed strip formed from the view point of heat transfer efficiency) is formed to extend to the end edge of the heat transfer plate 2 and intersect with the first gasket fitting groove 20, it may be configured such that the fitting recessed portion 25, which crosses the recessed strip, is formed, and the regulating member 5 is fitted in the fitting recessed portion 25.

In the present embodiment, for the first gasket 3 provided to define the flow channels (the first flow channel A and the second flow channel B) formed between each adjacent heat transfer plates 2, the fitting recessed portion 25 for fittingly receiving the regulating member 5 is formed. However, the present invention is not necessarily limited thereto. For example, for the second gasket 4 provided to define the connection flow channels (the first connection flow channel R1 and the second connection flow channel R2) that are flow channels formed to extend across the respective heat transfer plates 2 stacked to each other, a fitting recessed portion for fittingly receiving the regulating member 5 may be formed. That is, in the case where a recessed strip crossing the second gasket fitting grooves 21 is formed, it may be configured such that a fitting recessed groove crossing this recessed strip is formed, and a regulating member having the same configuration as that of the above embodiment is fitted in this fitting recessed groove. When the width (groove width) of recessed strips is relatively small, the gaskets 3 and 4 are not easy to enter into these recessed strips even when the gaskets 3 and 4 are pressed by the action of the fluid pressure. Therefore, when the groove width of recessed strips is large or when recessed strips having a groove width large enough to make the gaskets 3 and 4 easy to enter by the action of the fluid pressure, it may be configured such that the fitting recessed portion 25 is provided in each of the heat transfer plates 2 and the regulating member 5 to be fitted in the fitting recessed portion 25 is provided.

In the present embodiment, the fitting recessed portion 25 is provided on each of both sides of the gasket fitting groove 20, and the regulating member 5 is fitted into each of the fitting recessed portions 25. However, the present invention is not necessarily limited thereto. That is, the fitting recessed portion 25 may be provided only on the outer side of the gasket fitting grooves 20 and 21, which define areas serving as at least the flow channels A, B, R1 and R2, and the regulating member 5 may be fitted in this fitting recessed portion 25. Even in this configuration, the support part 50 of the regulating member 5 supports the gaskets 3 and 4 when the gaskets 3 and 4 have been pressed outward upon action of the fluid pressures of the fluid mediums H and C circulating through the flow channels A, B, R1 and R2. Thus, in the same manner as the above embodiment, the gaskets 3 and 4 are prevented from being partially moved into the recessed strips due to the action of the fluid pressures. Accordingly, the relative positional relationship between the gaskets 3 and 4 and the respective heat transfer plates 2 can be kept constant, so that the sealing performance (sealing performance between each adjacent heat transfer plates 2) of the flow channels A and B (the first flow channel A and the second flow channel B) is maintained. As a result, it is possible to prevent occurrence of fluid leakage.

Figure 13:
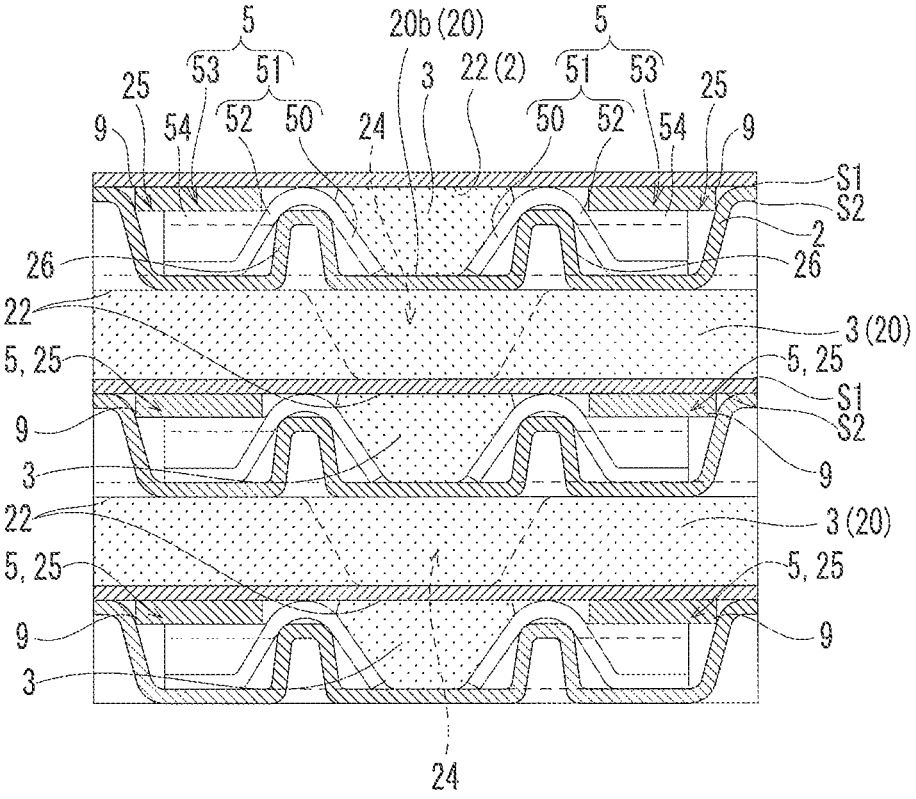
FIG. 13 is a partially enlarged cross sectional view of the plate heat exchanger according to another embodiment of the present invention, and specifically a partially enlarged cross sectional view, which includes a crossing portion between the first gasket fitting groove and the recessed strip (annular groove), and its periphery.
Figure 14A:
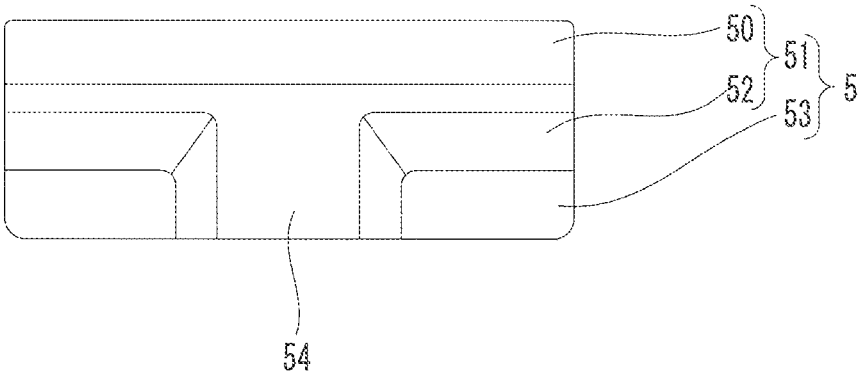
FIG. 14A is a plan view of a regulating member of the plate heat exchanger of still another embodiment of the present invention.
Figure 14B:
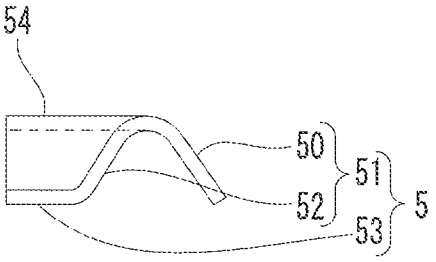
FIG. 14B is a side view of the regulating member of the plate heat exchanger of the other embodiment of the present invention.

In the above embodiment, the regulating member 5 is fixed in position by welding or adhesive tape in the state where the regulating member 5 is held in fitting engagement with the fitting recessed portion 25. However, as shown in FIG. 13, a pressing member 9 may be provided to press the extension part 53 of each regulating member 5. The pressing member 9 is formed of a strip member, which is formed by molding an elastic material, such as rubber and resin, and can be arranged in parallel to the cover part 51 of the regulating member 5. The pressing member 9 as provided is sandwiched by the stacked heat transfer plates 2 and hence is elastically deformed to keep pressing the regulating member 5 (extension part 53). Thus, it is possible to more securely fix the regulating member 5. Alternatively, it may be configured such that the regulating member 5 can regulate its movement without using the pressing member 9. That is, as shown in FIG. 14(*a*) and FIG. 14(*b*), the support part 50 and the reinforcing part 54 of the regulating member 5 may have the same height as each other so that the support part 50 and the reinforcing part 54 are allowed to come into contact with the adjacent heat transfer plate 2. With this configuration, the regulating member 5 is sandwiched by the two heat transfer plates 2 and therefore can be more securely fixed in position.

In the above embodiment, the regulating member 5 is formed by press molding a plate. However, the present invention is not necessarily limited thereto. The regulating member 5 may be formed by various processes, such as machining. The material of the regulating member 5 is not necessarily limited to a metal, but may be a resin, provided that it has stiffness to support the gaskets 3 and 4.

Figure 15:
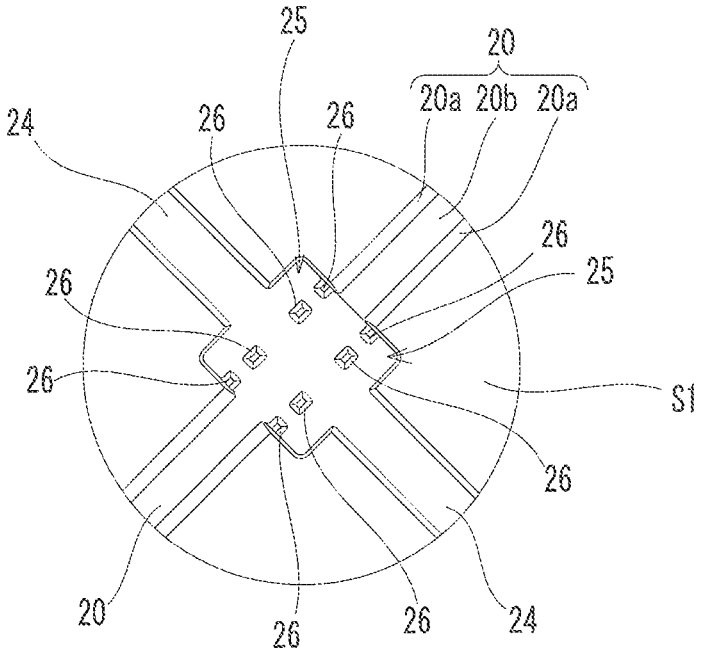
FIG. 15 is a partially enlarged plan view of the plate heat exchanger according to still another embodiment of the present invention, and specifically a partially enlarged plan view, which includes a crossing portion between the first gasket fitting groove and the recessed strip (annular groove), and its periphery.

In the above embodiment, only the positioning projections 26, which are formed by causing the vertical walls defining the fitting recessed portion 25 to bulge, are provided. However, the present invention is not necessarily limited thereto. For example, as shown in FIG. 15, additional positioning projections 26 may be provided at positions apart from the existing positioning projections 26, in addition to such existing positioning projections 26 which are formed by causing the vertical walls defining the fitting recessed portion 25 to bulge. In this case, the positioning projections 26 are arranged along the first gasket fitting groove 20 at positions avoiding the extending area of the recessed strip 24.

Figure 16:
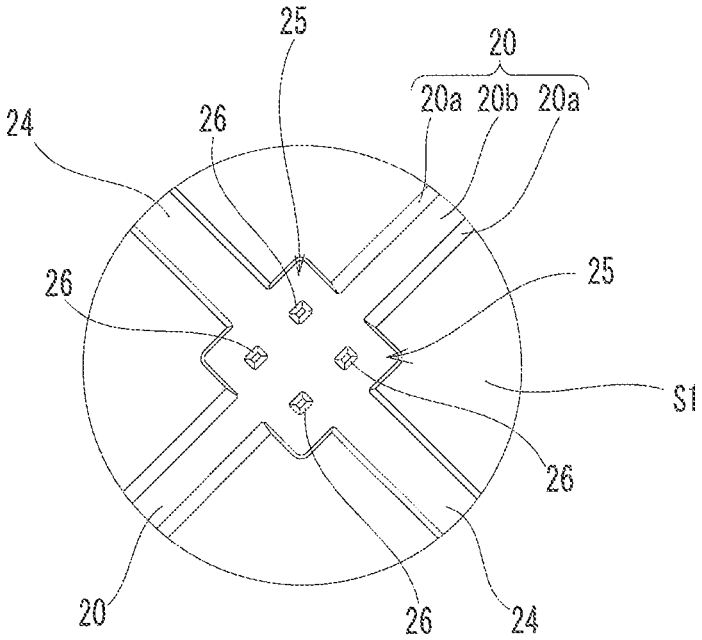
FIG. 16 is a partially enlarged plan view of the plate heat exchanger according to yet another embodiment of the present invention, and specifically a partially enlarged plan view, which includes a crossing portion between the first gasket fitting groove and the recessed strip (annular groove), and its periphery.

In the above embodiment, the positioning projections 26 are formed by causing the vertical walls defining the fitting recessed portion 25 to bulge. However, when the positioning projections 26 are provided, the form of the positioning projections 26 is not limited thereto. For example, the positioning projections 26 may be provided at positions away from the vertical walls defining the fitting recessed portion 25, as shown in FIG. 16.

In the above embodiment, the positioning projections 26 are provided in each of the fitting recessed portions 25 of the heat transfer plates 2. However, the present invention is not necessarily limited thereto. For example, the fitting recessed portion 25 may be of a simple recessed shape without the positioning projections 26. Even in this case, the regulating member 5 faces the vertical walls defining the fitting recessed portion 25 when it is held in fitting engagement with the fitting recessed portion 25, and therefore the regulating member 5 is prevented from moving along the side surface of the heat transfer plate 2.

In the above embodiment, the regulating member 5 is provided with the extension part 53. However, the present invention is not necessarily limited thereto. For example, the regulating member 5 may be subjected to various modifications, provided that the regulating member 5 is provided with a portion corresponding to the cover part 51, that is, a portion containing the support part 50 that can support the gaskets 3 and 4, and can be fitted in the fitting recessed portion 25.

In the above embodiment, the plate heat exchanger 1 has the first flow channel A and the second flow channel B being symmetrically arranged, and therefore a plurality of heat transfer plates 2 of the same type are provided, and the first flow channel A and the second flow channel B are formed by turning around every other heat transfer plate. However, the present invention is not necessarily limited thereto. For example, it is a matter of course that the plate heat exchanger 1 may be configured such that a plurality of heat transfer plates 2 of two types having different arrangement pattern of the gasket fitting grooves 20 and 21 defining the first flow channel A or the second flow channel B are alternately stacked. Even in this configuration, when the recessed strip 24 is formed in such a manner that it intersects with the gasket fitting grooves 20 and 21, the fitting recessed portion 25 crossing the recessed strip 24 is formed in each of the heat transfer plates 2 in recessed manner, and the regulating member 5 having the support part 50 is fitted in the fitting recessed portion 25 so that it is possible to produce the same operational effect as that of the above embodiment.

In the above embodiment, the first gasket fitting groove 20 is formed only on one side of each of the heat transfer plates 2. However, the present invention is not necessarily limited thereto. For example, the first gasket fitting groove 20 for fittingly receiving the first gasket 3 which defines the first flow channel A is formed on one side of each of the heat transfer plates 2, and the first gasket fitting groove 20 for fittingly receiving the first gasket 3 which defines the second flow channel B is formed on the other side of each of the heat transfer plates 2.

In the above embodiment, the plate heat exchanger 1 is formed by stacking independent heat transfer plates 2 to each other. However, the present invention is not necessarily limited thereto. For example, the plate heat exchanger 1 is formed by a stack of heat transfer cassettes, in which each heat transfer cassette is formed by welding the outer peripheral ends of the stacked two heat transfer plates 2 together, and the thus formed heat transfer cassettes are stacked to each other via the gaskets 3 and 4. In this case, the gasket fitting grooves 20 and 21 are formed on the outer side of one of each adjacent heat transfer cassettes (the side facing another adjacent heat transfer cassette), and the gaskets 3 and 4 are fitted in the gasket fitting grooves 20 and 21.

With the above configuration, any one of the first flow channel A and the second flow channel B is formed in between each adjacent heat transfer cassettes (between two heat transfer plates 2), and the other of the first flow channel A and the second flow channel B, which are defined by the gaskets 3 and 4, is formed in between each adjacent heat transfer cassettes. Accordingly, when the gasket fitting grooves 20 and 21 and the recessed strip 24 are formed so as to intersect with each other on the outer side of each of the heat transfer plates 2 which together form each heat transfer cassette, the fitting recessed portion 25 is formed in recessed manner so as to cross the annular groove 24, and the regulating member 5 is fitted in the fitting recessed portion 25, so that the gaskets 3 and 4 are prevented from partially moving.

Although no specific reference is made in the description on the above embodiment, it is preferable that a leading end surface (other end surface) of the support part 50 which forms the cover part 51 of the regulating member 5 be formed along the bottom wall 20*b* of the first gasket fitting groove 20. In order to form a leading end surface of the support part 50 along the bottom wall 20*b*, for example, the leading end portion (other end portion) of the support part 50 is diagonally cut to form an end surface inclined to the extension direction of the support part 50, so that, when the regulating member 5 is arranged in the fitting recessed portion 25, the leading end surface of the support part 50 is held in a position along the bottom wall 20*b* of the first gasket fitting groove 20. Alternatively, the leading end surface (other end surface) of the support part 50 may be formed to be held in a position along the bottom wall 20*b* of the first gasket fitting groove 20 by bending the leading end portion (other end portion) of the support part 50 and thereby adjusting the direction of the leading end surface (other end surface) of the support part 50. These configurations make it hard for the edge of the support part 50 to contact the first gasket 3 and therefore make it possible to prevent damages of the first gasket 3.

REFERENCE SIGNS LIST

1 Plate Heat Exchanger
2 Heat Transfer Plate
3 First Gasket (Gasket)
4 Second Gasket (Gasket)
5 Regulating Member
6, 7 Frame Plate
8 Tie Rod
9 Pressing Member
20 First Gasket Fitting Groove (Gasket Fitting Groove)
20*a* Vertical Wall
20*b* Bottom Wall
21 Second Gasket Fitting Groove (Gasket Fitting Groove)
21*a* Vertical Wall
21*b* Bottom Wall
22 First Flat Portion (Flat Portion)
23 Second Flat Portion (Flat Portion)
24 Annular Groove (Recessed Strip)
25 Fitting Recessed Portion
26 Positioning Projection
50 Support Part
51 Cover Part
52 Opposing Part
53 Extension Part
54 Reinforcing Part
A First Flow channel (Flow Channel)
B Second Flow channel (Flow Channel)
E Heat Transfer Area
H First Fluid Medium (Fluid Medium)
C Second Fluid Medium (Fluid Medium)
H1 First Opening (Opening)
H2 Second Opening (Opening)
H3 Third Opening (Opening)
H4 Fourth Opening (Opening)
R1 First Connection Flow Channel (Flow Channel)
R2 Second Connection Flow Channel (Flow Channel)
S1 First Side
S2 Second Side

What is claimed is:

1. A plate heat exchanger comprising:

a plurality of heat transfer plates stacked to each other; and a gasket interposed between each adjacent pair of heat transfer plates, wherein each of the plurality of heat transfer plates has a front side and a back side, at least one of which has a recessed strip;

wherein at least one of the front side and the back side of each of the plurality of heat transfer plates has a gasket fitting groove for fittingly receiving one of said gaskets, the gasket fitting groove intersecting with the recessed strip; and wherein a first flow channel for circulation of a first fluid medium and a second flow channel for circulation of a second fluid medium are alternately formed with each adjacent pair of heat transfer plates therebetween, and at least one of the first flow channel and the second flow channel is defined by the gasket interposed between each adjacent heat transfer plates, the plate heat exchanger further comprising:

a plurality of regulating members each having a support part that can at least partially support one of said gaskets;

wherein each of the plurality of heat transfer plates has a fitting recessed portion for fittingly receiving one of said regulating members, the fitting recessed portion being formed in recessed manner on the side on which the gasket fitting groove is formed, the fitting recessed portion crossing the recessed strip while extending along the gasket fitting groove; and wherein the support part is arranged along the gasket fitting groove when the regulating member is held in fitting engagement with the fitting recessed portion.

2. The plate heat exchanger according to claim 1, wherein the regulating member has a top which is located on the adjacent heat transfer plate side, and the top of the regulating member is formed to be positioned at a height equal to or lower than a top of a projected strip located on the same side as the side of the heat transfer plate on which the fitting recessed portion is formed.

3. The plate heat exchanger according to claim 1, wherein each of the plurality of heat transfer plates is formed by press molding a metal plate, and has:

an annular gasket fitting groove formed along an outer periphery of each of the flow channels on one of the front side and the back side; and a flat portion formed on the back side of the heat transfer plate along an outer periphery of the flow channel defined by the gasket fitted in the gasket fitting groove formed on the one of the front and back sides of another heat transfer plate adjacent to the other of the front and back sides of the heat transfer plate, the flat portion forming the recessed strip on the one of the front and back sides of the heat transfer plate, wherein the gasket fitting groove formed on the one of the front and back sides intersects with the flat portion formed on the other of the front and back sides.

4. The plate heat exchanger according to claim 1, wherein each of the plurality of heat transfer plates has a positioning projection within the fitting recessed portion, and the regulating member has a cover part for covering the positioning projection.

* * * * *